United States Patent [19]

Tolmie, Jr.

[11] 4,309,737

[45] Jan. 5, 1982

[54] CHARGE ROLLER SYSTEM FOR AN ELECTROPHOTOGRAPHIC COPIER

[75] Inventor: Robert J. Tolmie, Jr., Brookfield Center, Conn.

[73] Assignee: Pitney Bowes Inc., Stamford, Conn.

[21] Appl. No.: 181,935

[22] Filed: Aug. 27, 1980

[51] Int. Cl.[3] ..... G03G 15/044

[52] U.S. Cl. ..... 361/225; 355/3 CH

[58] Field of Search ..... 361/221, 225, 214; 355/3 CH

[56] References Cited

U.S. PATENT DOCUMENTS

| | | | |
|---|---|---|---|
| 2,863,063 | 11/1955 | Schulze | 361/225 |
| 3,778,690 | 12/1973 | Rothacker et al. | 361/225 |
| 4,049,343 | 9/1977 | Hermanson | 361/221 |
| 4,127,905 | 10/1979 | Metcalfe et al. | 361/225 |

FOREIGN PATENT DOCUMENTS

| | | | |
|---|---|---|---|
| 54-10944 | 8/1979 | Japan | 355/3 CH |

*Primary Examiner*—J. D. Miller
*Assistant Examiner*—L. C. Schroeder
*Attorney, Agent, or Firm*—Peter Vrahotes; William D. Soltow, Jr.; Albert W. Scribner

[57] ABSTRACT

A charge roller unit for an electrophotographic copier which has a construction that results in a substantially constant charge being imparted to a photoconductive surface independently of ambient temperatures. The constant charge is achieved through the provision of an underlying metallic support having a curvilinear surface such that the overlying conductive rubber material has a variable thickness.

7 Claims, 2 Drawing Figures

CHARGE ROLLER SYSTEM FOR AN ELECTROPHOTOGRAPHIC COPIER

BACKGROUND OF THE INVENTION

In the field of electrophotography, there are generally two types of copiers, coated paper copiers and plain paper copiers. Coated paper copiers generally have a photoconductive material coated onto a paper substrate. The coated paper is charged, imaged and developed to produce a copy. There are generally two ways of charging the coated paper, either through a corona or through charge rollers. In the charging by use of charge rollers, the coated paper is conveyed between two biased rollers, one of which is resilient and the other rigid.

Prior charge roller systems for electrophotographic copiers do not impart uniform charging to a photoconductor over the entire range of ambient conditions. The main reason for this shortcoming is that the resistance of the charge rollers can change significantly with variation in the temperature. This change in resistance prevents the charge roller from working at low temperatures because the voltage at the paper charge roller interface is not great enough to charge the copy paper. Decreasing the thickness of the conductive rubber on the roller would decrease the variability in resistance and give more stable operation over the environmental envelope, except that new problems arise due to the thinner cover. The reduced coating thickness causes high power supply current to be drawn, due to the reduced impedance, and possibly could cause corona due to the sharp edge of the metal insert. This is especially true where the negative charge roller comes in contact with a positive metal ground roller and where the paper does not extend to the end of the conductive rubber cover.

SUMMARY OF THE INVENTION

In order to overcome the problems of prior charge roller systems that are associated with ambient temperature changes, it has been found that the inner portion of a charge roller can be modified so that the outer edges thereof are formed into a radius. In this way, the conductive rubber coating thickness is increased just before it extends beyond the width of the paper. More specifically, it has been found that by gradually increasing the thickness of the rubber coating, starting at the point where the paper intersects with the inner metal roller or slightly before such intersection, to the end of the roller, the conductive rubber cover thickness may be reduced by approximately 50%, in the area where the paper comes in contact with the two rollers, as compared to prior systems without experiencing the prior problems.

DETAILED DESCRIPTION OF THE PREFERRED EMBODIMENT

Figure 1:
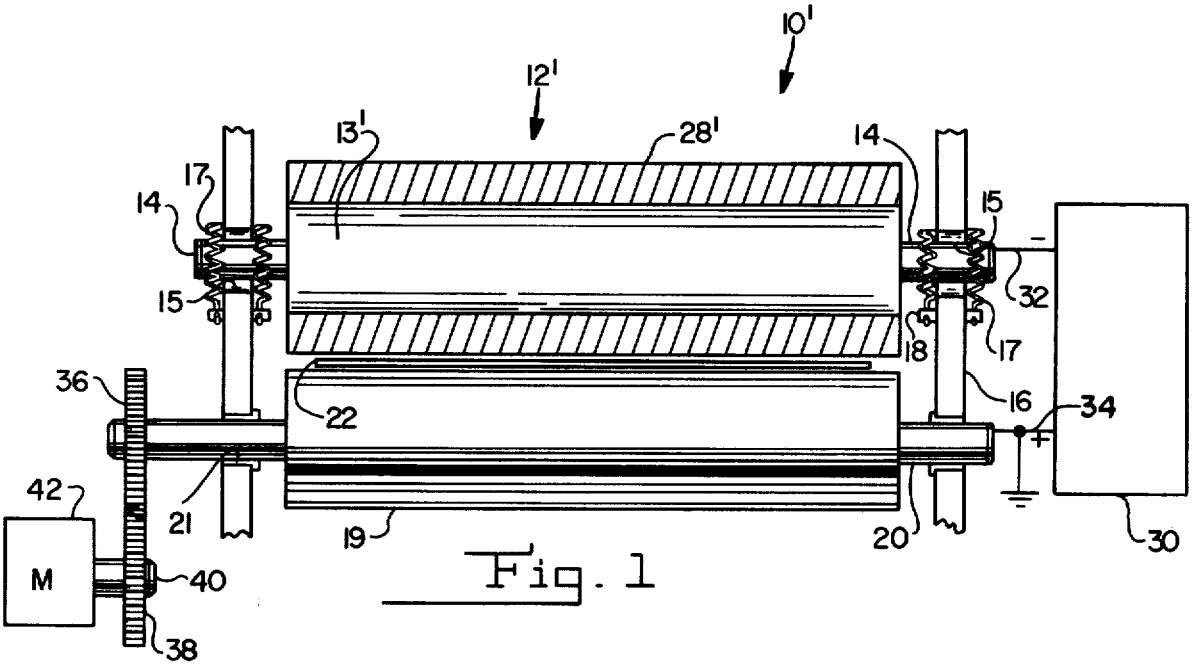
FIG. 1 shows a longitudinal, cross sectional view of a prior art charge roller unit.
Figure 2:
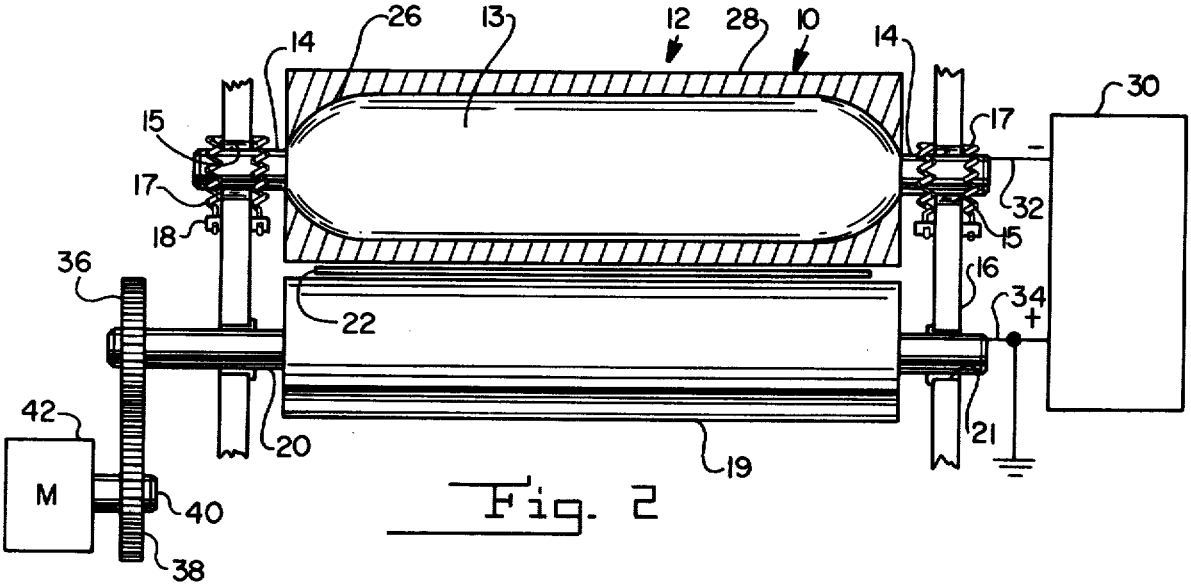
FIG. 2 shows a longitudinal, cross sectional view, partially schematic, of a charge roller unit that incorporates the features of the instant invention.

In the attached drawing, FIG. 1 shows a typical prior art charge roller unit and FIG. 2 shows a charge roller unit manufactured in accordance with the instant invention. The same numbers are used for identical parts and those parts of the respective units that differ from one another are distinguished by the use of prime numbers in FIG. 1. Referring now to the drawing, a charge roller unit incorporating the instant invention is shown generally at 10 and a prior art charge roller unit is shown at 10'. Such a unit 10, 10' is made up of a charge roller 12, 12' which includes a metallic inner portion 13, 13' having integral therewith a pair of opposed longitudinally extending stub shafts 14. The stub shafts 14 are received within slots 15 of a housing 16, there being a spring 17 secured to the housing 16, as by a pin 18, at the location of each slot. These springes 17 urge the charge rollers 12, 12' downwardly as seen in the drawing. Disposed about the metallic inner portion 13, 13' is a cover 28, 28' made of a resilient, conductive material such as butadiene-acrylonitrile.

Spaced adjacent to the charge roller 12, 12' is a ground roller 19 which is made of a metal, such as stainless steel, and includes a pair of opposed integral stub shafts 20 that are journaled into openings 21 of the housing 16 to be rotated therein. A sheet 22 is shown located between the charge rollers 12, 12' and the ground roller 19.

Adjacent to the charge roller unit 10 is a power supply 30 that has a negative lead 32 in electrical connection with one of the stub shafts 14 of the charge roller 12 and a grounded positive lead 34 that is in electrical connection with a stub shaft 20 of the ground roller 19. This power supply creates an electrical bias between the charge roller 12 and ground roller 19 such that an electrostatic charge may be induced on the photoconductive sheet 22. A gear 36 is mounted on one of the stub shafts 20 and is in meshing engagement with another gear 38 that is secured to the output shaft 40 of a motor 42. The motor 42 provides drive to the roller 19 which in turn provides drive to the charge roller 12.

Referring more specifically to FIG. 1, as is standard in the construction of charge rollers 12', the metallic core 13' has disposed about its perimeter the cover of resilient, conductive material 28'. The cover 28' is securely fastened to the metallic core 13' so as to be rotated therewith. The metallic core 13' and stub shafts 14 may be manufactured from a single cylindrical metallic member by machining. It will be observed that the perimeter 24' of the core 13' has the form of a right cylinder with the sides thereof being linear and the thickness of the conductive cover is uniform from one longitudinal end to another.

It has been found that this type of configuration results in the charge roller unit 10' being inoperative a low temperatures because of the resulting high resistance of the charge roller 12'. For example, it has been found that at 70° F. a charge roller 12' having the configuration shown in FIG. 1 will have a resistance of approximately 100 meg ohm, whereas 90° F. it will have a resistance of 20 meg ohm. This increase in resistance a low temperatures prevents the charge roller 12' from working effectively because the voltage at the copy paper 22 interface is not at a sufficient level to adequately charge the copy paper 22. Decreasing the sleeve 28' thickness would decrease the variability in resistance and give more stable resistance with charges in ambient temperatures, but this would result in other problems. Such problems would include the drawing of more current due to reduced impedance.

It has been found that the problem of changing resistance in the sleeve 28' with change in ambient temperatures can be overcome with the configuration of a charge roller 10 as shown in FIG. 2. The inner core 13 has a curvilinear profile at the longitudinal ends with an accompanying increase in sleeve 28 thickness at the longitudinal ends. More importantly, a relative thin cover 12 portion extends almost along the entire dimension of the sheet 22.

With regard to the curvilinear profile 26 of the cylindrical portion 24 of the charge roller 12, the same may be a radius from 0.10 to 0.18; the preferred being a radius of approximately 0.14. It has been found that with a charge roller 12 of this configuration the resulting variable thickness of the conductive rubber coating 28 is such that the charge capability of the charge roller 12 remains in a useful range despite variations in ambient temperatures.

What I claimed is:

1. A charge roller that cooperates with a ground roller in a charge roller unit to create an electrostatic charge on a photoconductive copy sheet passed through the unit, comprising:

a longitudinally extending metallic body having a pair of stub shafts disposed on opposite longitudinal ends sides thereof, said metallic body having a curvalinear profile at the vicinity of the junction with each of said stub shaft and a conductive, resilient sleeve disposed about said metallic body, said sleeve providing a linear longitudinal surface about its outside perimeter.

2. The charge roller of claim 1 wherein said curvilinear profile is a radius of 0.10 to 0.18.

3. The charge roller of claim 1 wherein said curvilinear profile is a radius of approximately 0.14.

4. The charge roller of claim 1 wherein said conductive, resilient sleeve is made of butadieneacylonitrile.

5. A charge roller unit for creating an electrostatic charge on a copy sheet comprising:

a housing;

a longitudinally extending charge roller having a metallic body with a pair of stub shafts disposed on opposite longitudinal ends thereof, said stub shafts being rotatably received within said housing, said metallic body having a curvilinear profile at the junctions with each of said stub shafts;

a conductive, resilient sleeve disposed about said metallic body, said sleeve providing a linear longitudinal surface about its outside perimeter;

a longitudinally extending ground roller having a pair of stub shafts at the longitudinal ends thereof, said ground roller stub shafts being rotatably received within said housing to place said charge roller and ground roller in mating relationship with one another;

means for providing an electrical bias to one of said rollers; and means for rotating one of said rollers.

6. The charge roller unit of claim 5 including means for urging said rollers toward one another.

7. The charge roller unit of claim 5 wherein said conductive, resilient sleeve is made of butadieneacrylonitrile.

* * * * *